US007580000B2

(12) United States Patent
Kai et al.

(10) Patent No.: US 7,580,000 B2
(45) Date of Patent: Aug. 25, 2009

(54) FOLDING DIPOLE ANTENNA AND TAG USING THE SAME

(75) Inventors: Manabu Kai, Kawasaki (JP); Toru Maniwa, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/411,498

(22) Filed: Apr. 26, 2006

(65) Prior Publication Data

US 2007/0176839 A1 Aug. 2, 2007

(30) Foreign Application Priority Data

Jan. 31, 2006 (JP) ..... 2006-023646

(51) Int. Cl.
*H01Q 9/26* (2006.01)

(52) U.S. Cl. ..... 343/803; 343/730; 343/795; 340/572.7

(58) Field of Classification Search ..... 343/700 MS, 343/895, 767, 803, 727, 730, 795; 340/572.7
See application file for complete search history.

(56) References Cited

U.S. PATENT DOCUMENTS

| | | | | |
|---|---|---|---|---|
| 5,414,427 | A | 5/1995 | Gunnarsson | |
| 6,320,509 | B1 * | 11/2001 | Brady et al. | 340/572.7 |
| 6,653,983 | B2 * | 11/2003 | Masuda et al. | 343/767 |
| 7,298,330 | B2 * | 11/2007 | Forster et al. | 343/700 MS |
| 2003/0006901 | A1 | 1/2003 | Kim et al. | |
| 2005/0024287 | A1 | 2/2005 | Jo et al. | |
| 2005/0092845 | A1 | 5/2005 | Forster | |
| 2005/0093678 | A1 | 5/2005 | Forster et al. | |
| 2005/0153756 | A1 | 7/2005 | Sato et al. | |

FOREIGN PATENT DOCUMENTS

| | | |
|---|---|---|
| EP | 1617506 | 1/2006 |
| JP | 6-501595 | 2/1994 |
| JP | 2004-503125 | 1/2004 |
| JP | 2005-45339 | 2/2005 |
| JP | 2005-203830 | 7/2005 |
| JP | 2005-203878 | 7/2005 |
| JP | 2005-236468 | 9/2005 |
| WO | 9840930 | 9/1998 |

OTHER PUBLICATIONS

Notification of Remarks Submission dated Aug. 13, 2007, from the corresponding Korean Application.

(Continued)

*Primary Examiner*—Michael C Wimer
(74) *Attorney, Agent, or Firm*—Katten Muchin Rosenman LLP

(57) ABSTRACT

In a folded dipole antenna, both ends of a first dipole portion with a feeding portion are connected to both ends of a second dipole portion so that a slot portion may be formed, and the first and the second dipole portion have a width for generating a linearly-polarized wave in a slot mode (in a longitudinal direction) when an RFID chip is mounted on the feeding portion. A terminal of a chip is actually connected to an antenna terminal of the feeding portion of the folded dipole antenna to realize a tag.

7 Claims, 12 Drawing Sheets

OTHER PUBLICATIONS

Extended European Search Report and Annex to the European Search Report dated Jun. 15, 2007 for corresponding European Application EP 06 00 8706.1-2220.

Antenna Engineering Handbook by Ohmsha, May 13, 1999.

Official Letter dated Nov. 25, 2008, from the corresponding Taiwanese Application.

Notification of Reason for Refusal dated Mar. 24, 2009, from the corresponding Japanese Application.

Ryo Shimizu, et al. "A Study on Broadband Planar Antenna" Technical Report of IEICE, Institute of Electronics, Information and Communication Engineers, Jul. 16, 2004, pp. 69-75.

* cited by examiner $$\left( \begin{array}{l} Ya \\ = 1 / Ra + 1 / j\omega La \\ = Ga - jBa \end{array} \right) \qquad \left( \begin{array}{l} Yc \\ = 1 / Rc + j\omega Cc \\ = Gc + jBc \end{array} \right)$$

FOLDING DIPOLE ANTENNA AND TAG USING THE SAME

BACKGROUND OF THE INVENTION

1. Field of the Invention

The present invention relates to a folded dipole antenna and a tag using the same, and in particular to a noncontact folded dipole antenna for a signal transmission/reception to/from an RFID reader/writer, and an RFID tag using the same.

2. Description of the Related Art

An RFID system has been already known in which a reader/writer transmits a signal of approximately 1 W via a radio line of a UHF bandwidth (860-960 MHz), and a tag receives the signal and returns a response signal to the reader/writer, thereby enabling information within the tag to be read by the reader/writer. It is stipulated that the communication frequency is 953 MHz, whereby the communication distance is approximately 3 m, while it depends on the gain of an antenna provided on the tag and the operation voltage and a peripheral environment of a chip. The tag is composed of an antenna approximately 0.1 mm thick and an LSI chip (whose size is approximately 1 mm square and 0.2 mm thick) connected to an antenna feeding portion.

As shown in FIG. 8, an LSI chip 21 can be equivalently represented by a parallel circuit of an internal resistance Rc (e.g. 1200 Ω) and a capacitance Cc (e.g. 0.7 pF). An admittance Yc (=1/Rc+jwCc) of the chip 21 is indicated at a position A21 on an admittance chart of FIG. 9. On the other hand, an antenna 22 can be equivalently represented by a parallel circuit of a radiation resistance Ra (e.g. 500 Ω) and an inductance La (e.g. 40 nH).

By connecting the chip 21 to the antenna 22 in parallel, the capacitance Cc and the inductance La resonate with each other and make impedance matching at a desired resonant frequency fo (the above-mentioned 953 MHz), so that the maximum reception power at the antenna 22 is supplied to the chip 21, as seen from the following equation.

$$fo = \frac{1}{2\pi\sqrt{LC}} \qquad \text{Eq. (1)}$$

As a basic antenna used for an RFID tag, a dipole antenna 31 approximately 145 mm (λ/2) long shown in FIG. 10A can be mentioned. The impedance in this case plots a track (1) in FIG. 9. At fo=953 MHz, Ra assumes 72 Ω and the imaginary part assumes 0, which are indicated at a position A31 on the track (1).

Since the radiation resistance Ra required for the antenna of the RFID tag is as extremely high as approximately 500-2000 Ω, the radiation resistance Ra is required to be raised from 72 Ω.

It is well known that with a folded dipole antenna 32 approximately 145 mm long as shown in FIG. 10B the radiation resistance Ra is raised from 72 Ω of the dipole antenna to approximately 300 Ω-500 Ω, depending on a line width (see e.g. non-patent document 1).

FIG. 9 shows that the impedance of the folded dipole antenna 32 plots a track (2), and at fo=953 MHz, Ra assumes 500 Ω and the imaginary part assumes 0, which are indicated at a position A32 on the track (2).

Furthermore, by connecting an inductance portion 33 in parallel to the folded dipole antenna 32 shown in FIG. 10B as shown in FIG. 10C, the track (2) on the admittance chart of FIG. 11 is rotated counterclockwise, so that the impedance can be indicated at a position A33 on the track (3) with an imaginary component (Ba=−1/ωLa) of the same absolute value as the imaginary component (Bc=ωCc) of the admittance of the chip 21. In this case, the shorter the length of the inductance portion 33 becomes, the smaller the value of the inductance La becomes, which leads to a large imaginary component and a large rotation amount.

Since the imaginary component Bc of the chip 21 has the same magnitude as that of the imaginary component Ba of the antenna 22, they are cancelled mutually and the resonance occurs at the frequency fo. The canceling of the imaginary components is the most important element upon designing an RFID tag. Although matching between the internal resistance Rc of the chip 21 and the radiation resistance Ra of the antenna 22 is the most preferable, it is not necessary to strictly match them with each other.

On the other hand, there is a radio tag operating in two frequency bands by arranging a non-feeding element of a half wavelength resonating in 2.4 GHz band formed by a conductive pattern on the opposite side of a folded dipole antenna across a dielectric sheet at the folded dipole antenna resonating in 900 MHz band formed by the conductive pattern on the dielectric sheet, and by performing impedance matching for two frequency bands (see e.g. patent document 1).

[Non-patent document 1] Antenna engineering handbook: Page 112 (published on Mar. 5, 1999 by Ohmsha)

[Patent document 1] Japanese Patent Application Laid-open No. 2005-236468

FIG. 11 shows an arrangement of the above-mentioned RFID system. An R/W-end antenna 13 connected to a reader/writer (R/W) 11 through a cable 12 is a patch antenna or the like having a circularly-polarized wave characteristic. Since an electric field direction "A" from the reader/writer 11 is always rotated as shown in FIG. 11, a tag 15 with an antenna which is generally a linearly-polarized wave can transmit/receive a signal to/from the reader/writer 11 through a radio wave propagation path 14, whichever direction the tag 15 faces.

When the folded dipole antenna shown in FIG. 10B is used for the tag 15, the folded dipole antenna also has a linearly-polarized wave characteristic. Therefore, if an appropriate electric field can be generated in a surface orthogonal to a linearly-polarized wave surface specific to the folded dipole antenna, a polarized wave orthogonal to the electric field direction from the reader/writer 11 at a certain point can be received, and the communication distance of the tag 15 can be extended.

Although there has been known a cross dipole as shown in FIG. 12, it makes the tag too huge for the practical use.

SUMMARY OF THE INVENTION

It is accordingly an object of the present invention to provide a folded dipole antenna which can extend a communication distance even if a reader/writer has a circularly-polarized wave characteristic, and a tag using the folded dipole antenna.

In order to achieve the above-mentioned object, a folded dipole antenna according to the present invention comprises: a first dipole portion with a feeding portion; and a second dipole portion in which a slot portion is formed and to which both ends of the first dipole portion are connected; the first and the second dipole portion having a width for generating a linearly-polarized wave in a longitudinal direction, when a chip is mounted on the feeding portion.

Namely, in the present invention, the first and the second dipole portion are mutually connected so as to form a slot portion. Supposing that a chip is mounted on a feeding portion of the first dipole portion in this state, the first and the second dipole portion form a high-frequency circuit (one of the antenna terminals—second dipole portion—the other antenna terminal) through the slot portion. Therefore, the feeding portion is generated or provided through the slot portion between the first and the second dipole portion, whereby the dipole portions and the slot portion operate as a slot antenna, and a longitudinal linearly-polarized wave orthogonal to the direction of the linearly-polarized wave surface by the first dipole portion is generated.

Thus, a lateral linearly-polarized wave (dipole mode) by the first dipole portion and the longitudinal linearly-polarized wave orthogonal thereto (slot mode) concurrently operate, thereby enabling an appropriate dual mode-polarized wave characteristic (substantially circularly-polarized wave characteristic or elliptically-polarized wave characteristic) to be provided, and increasing a matching degree with the circularly-polarized wave of the reader/writer.

Also, an inductance portion for impedance matching with the chip may be connected to the first dipole portion, in parallel with the above-mentioned feeding portion.

By providing an inductance portion in this way, costs and labor hour can be reduced in comparison with a case where a chip inductance commercially available is used.

Also, a tag is realized by connecting input/output terminals of the chip to antenna terminals of the above-mentioned feeding portion.

Namely, the folded dipole antenna is premised on mounting a chip on the feeding portion in the above-mentioned case, although the chip is not mounted on the feeding portion. By actually connecting input/output terminals of the chip to antenna terminals of the feeding portion, a tag on which a chip is actually mounted is realized.

Accordingly, the linearly-polarized wave in the dipole mode is generated in the first dipole portion, so that the formation of a high-frequency circuit equivalently makes even the slot portion substantially mounting thereon the feeding portion. Therefore, the longitudinal linearly-polarized wave in the slot mode is generated between the first and the second dipole portion, and a degree of matching with the circularly-polarized wave of the reader/writer is increased.

In the above-mentioned case, the input/output terminals of the chip are connected only to an antenna terminal of the first dipole portion and not to the terminal of the second dipole portion. However, a second terminal such as a monitor terminal may be provided for such a chip, in which by directly connecting the second terminal to the second dipole portion as well, an internal capacitance of the chip itself intervenes between the second terminal and one of the antenna terminals, which leads to the same electric potential on a high frequency basis. Thus, the high-frequency circuit (one of the antenna terminals—second terminal—second dipole portion—the other antenna terminal) is formed between the first and the second dipole portion in the same way as the above, so that the linearly-polarized wave in the slot mode is generated through the slot portion.

Furthermore, a land pattern may be provided in the above-mentioned slot portion and another terminal of the above-mentioned chip may be connected to the land pattern.

Namely, not by connecting the above-mentioned second terminal of the chip to the second dipole portion, but by connecting it to a land pattern provided in the slot portion, the land pattern and one of the antenna terminals of the first dipole portion are coupled on a high frequency basis by the internal capacitance to assume the same electric potential. Furthermore, the high-frequency coupling occurs between the land pattern and the second dipole portion by the capacitance. Therefore, the high-frequency circuit of one of the antenna terminals—land pattern-second dipole portion—the other antenna terminal is formed, the substantial feeding portion is generated between the first dipole portion and the second dipole portion, thereby enabling the linearly-polarized wave in the slot mode in addition to the linearly-polarized wave in the dipole mode to be generated in the same way as the above.

The above-mentioned first and the second dipole portion may comprise conductors consisting of Cu, Ag, or Al, and may be fixed on a sheet consisting of PET, film, or paper.

As mentioned above, according to the present invention, not only a linearly-polarized wave in a dipole mode at a certain point from a reader/writer but also a linearly-polarized wave orthogonal thereto in a slot mode in the dipole mode can be transmitted/received. Therefore, it is possible to improve a matching degree with a circularly-polarized wave from the reader/writer, thereby enhancing a communication distance.

BRIEF DESCRIPTION OF THE DRAWINGS

The above and other objects and advantages of the invention will be apparent upon consideration of the following detailed description, taken in conjunction with the accompanying drawings, in which the reference numerals refer to like parts throughout and in which.

DESCRIPTION OF THE EMBODIMENTS

Figure 1:
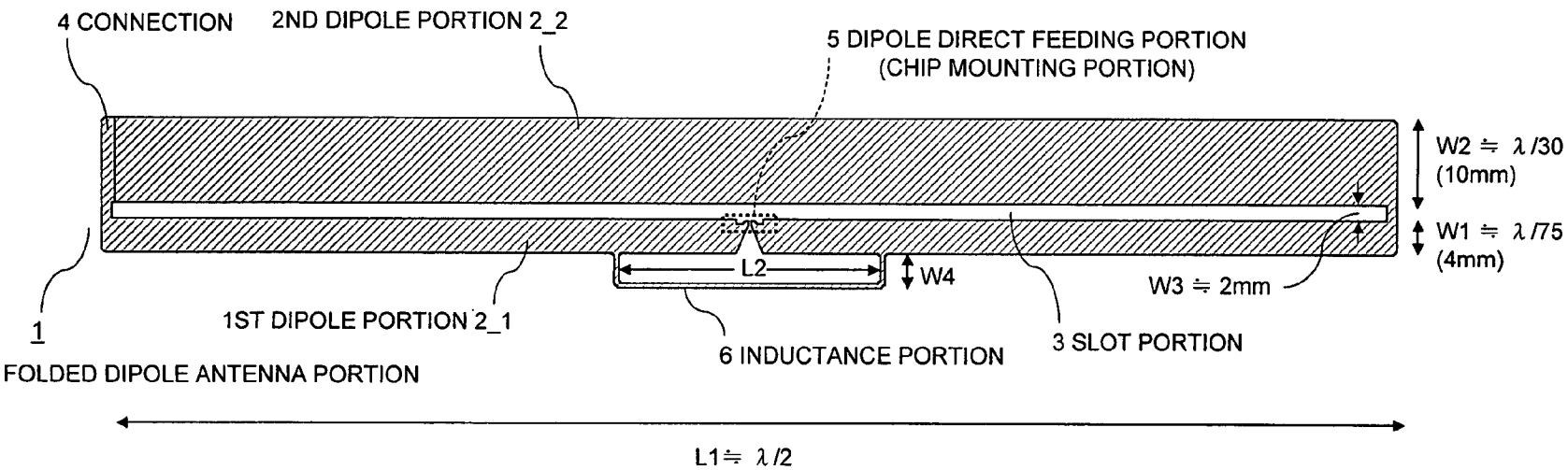
FIG. 1 is a plane view showing an embodiment of a folded dipole antenna according to the present invention.

Embodiment of Folded Dipole Antenna: FIG. 1

FIG. 1 shows a folded dipole antenna 1 according to the present invention. In this embodiment, both ends of a first dipole portion 2_1 and a second dipole portion 2_2 are mutually connected with a connection 4 so as to form a slot portion 3. At an intermediate point of the first dipole portion 2_1, a feeding portion 5 where an RFID chip can be mounted is provided, and an inductance portion 6 is connected to the first dipole portion 2_1 in parallel with the feeding portion 5.

In this folded dipole antenna 1, a width W1 of the first dipole portion 2_1 assumes approximately λ/75=4 mm, a width W2 of the second dipole portion (folded portion) 2_2 assumes approximately λ/30=10 mm, and a width W3 of the slot portion 3 assumes approximately 2 mm. Furthermore, an overall length L1 assumes λ/2=144 mm, and a length L2 of the inductance portion 6 is set to a length (lateral length L2=approximately 30 mm, longitudinal length W4=approximately 4 mm) by which resonance may occur with La=40 nH when a chip capacitance Cc mounted on the feeding portion 5 assumes 0.7 pF.

It is to be noted that the above-mentioned dimension example of the folded dipole antenna 1 will be described in detail later.

Embodiment [1] of Tag

Figure 2:
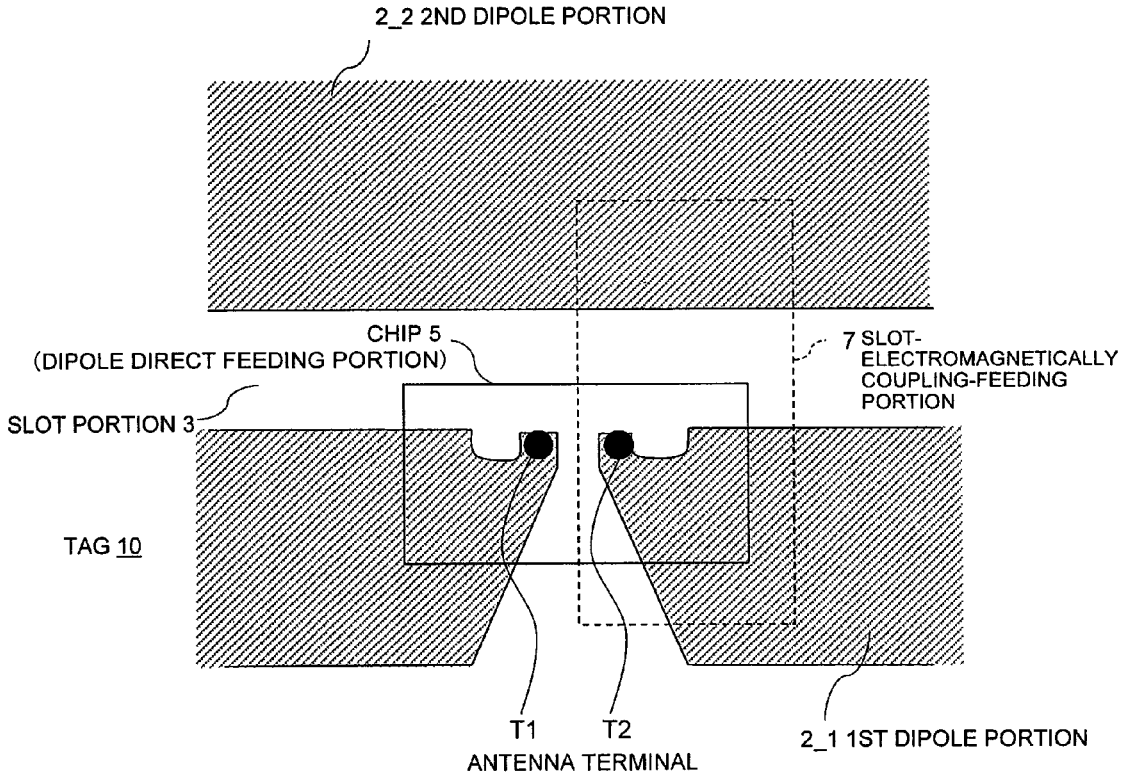
FIG. 2 is a plane view showing in closeup a vicinity of a chip mounting part of an embodiment [1] of a tag according to the present invention.

FIG. 2 shows an embodiment of a tag 10 realized by actually mounting a chip in the folded dipole antenna 1 shown in FIG. 1. The diagram of this embodiment shows in closeup a vicinity of the feeding portion 5 in FIG. 1, where a chip is mounted on a position of the feeding portion 5, which is also referred to as chip 5, and input/output terminals (not shown) of the chip are connected to antenna terminals T1 and T2 of the first dipole portion 2_1.

Figure 3:
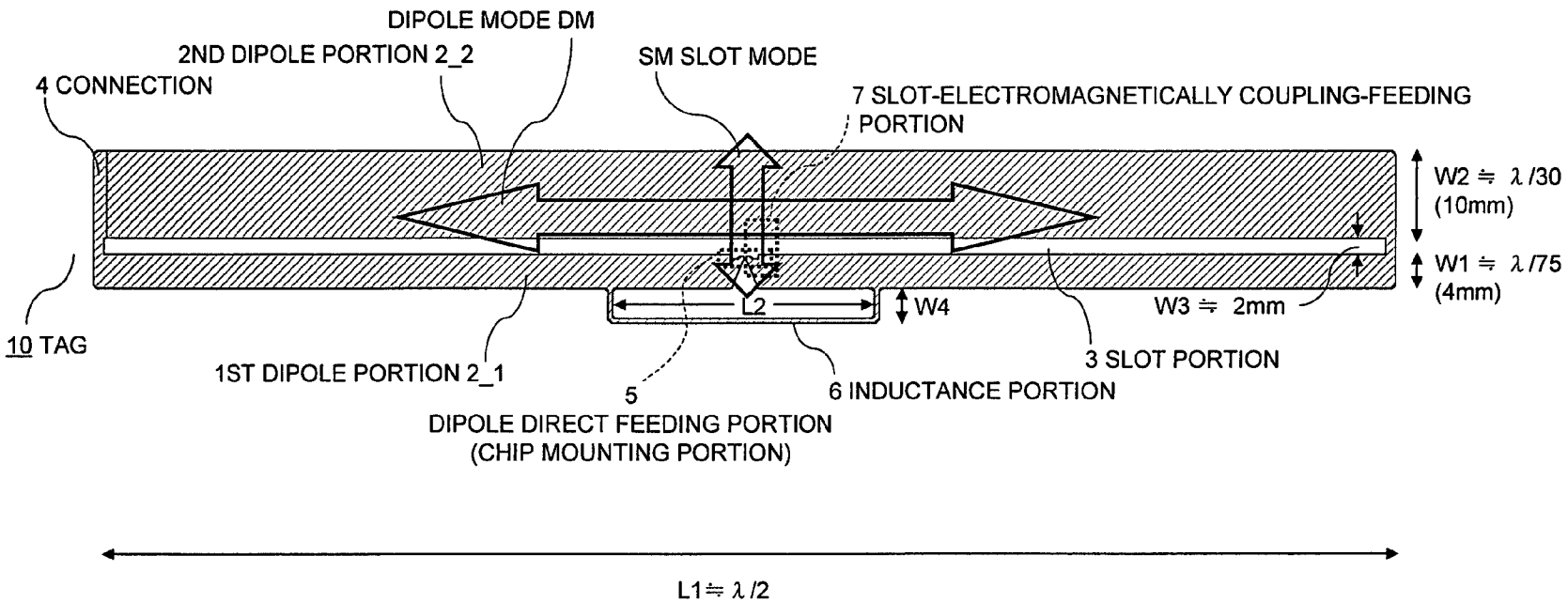
FIG. 3 is a diagram illustrating an operation of a tag according to the present invention.

If the chip 5 is actually mounted on the feeding potion 5 that is a chip mounting portion, a linearly-polarized wave in a dipole mode DM by a direct feeding as shown in FIG. 3, i.e. a linearly-polarized wave in a lateral direction on the drawing sheet is generated in the first dipole portion 2_1 subject to a direct feeding.

Since the first dipole portion 2_1 and the second dipole portion 2_2 are set wider than a general folded dipole antenna, the first dipole portion 2_1 and the second dipole portion 2_2 form a circuit consisting of the antenna terminal T2—second dipole portion 2_2—capacitance between both dipole portions—antenna terminal T1 in a high-frequency (e.g. 953 MHz) through the slot portion 3 shown by a dotted line in FIG. 2, so that a feeding portion 7 is generated between the antenna terminal T2 and the second dipole portion 2_2. Thus, the feeding portion 7 is provided across the slot portion 3, thereby generating a linearly-polarized wave in a slot mode SM (longitudinal direction on the drawing sheet) as shown in FIG. 3.

The radiation resistance of the slot portion 3 at this time is approximately 1000-3000 Ω by simulation, which matches with a general impedance (e.g. 1200 Ω) of the chip 5 mounted.

Thus, the lateral linearly-polarized wave in the dipole mode DM mainly serves and the longitudinal linearly-polarized wave in the slot mode SM supplementally serves, so that an appropriate dual mode-polarized wave characteristic is provided by the tag 10 as a whole. It becomes possible to transmit/receive not only the dipole linearly-polarized wave from the reader/writer at a certain point but also the linearly-polarized wave orthogonal thereto in the slot mode, so that a communication distance can be increased.

Now, the reasons why the dimensions of the folded dipole antenna 1 are adopted as shown in FIG. 1 will be described.

Figure 4:
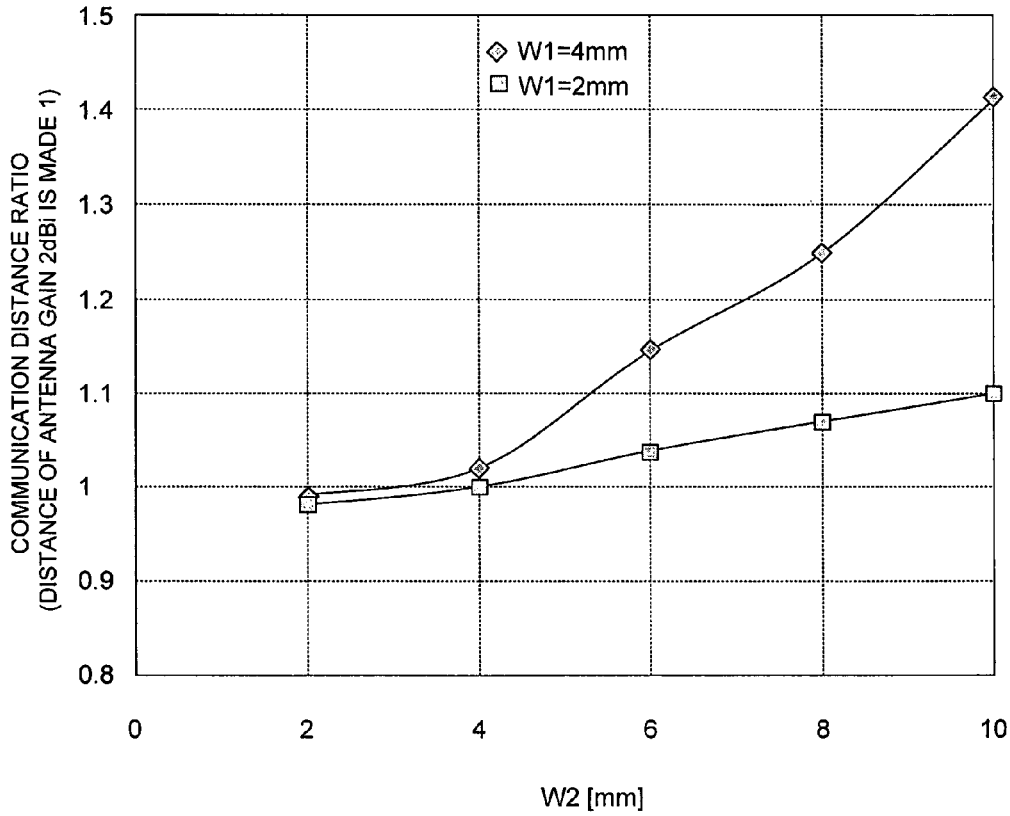
FIG. 4 is a graph showing a relationship between a width of a dipole portion used in the present invention and a communication distance ratio.

FIG. 4 shows a graph of a relationship between the width W2 of the second dipole portion 2_2 and the communication distance ratio, obtained by an electromagnetic field simulator commercially available, with the width W1 of the first dipole portion 2_1 as a parameter. As seen from this graph, the communication distance ratio increases in approximate proportion to the width W2 of the second dipole portion 2_2, and the communication distance ratio in a case where the width W1 of the first dipole portion 2_1 is 4 mm is increased more than a case where the width W2 is 2 mm. This graph indicates that when the width W1 of the first dipole portion is 4 mm and the width W2 of the second dipole portion is 10 mm, the communication distance approximately 1.4 times as long as that of the general folded dipole antenna generating only the linearly-polarized wave can be obtained.

Figure 5:
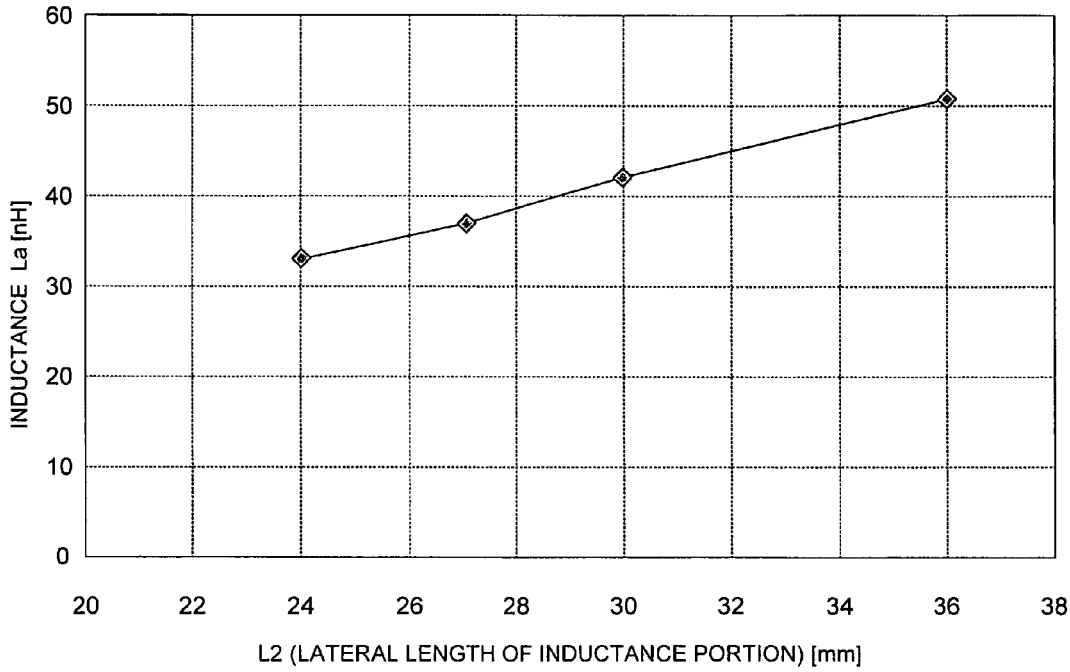
FIG. 5 is a graph showing a relationship between a length of an inductance portion used in the present invention and an inductance.

FIG. 5 also shows a graph of a relationship between the lateral length L2 of the inductance portion 6 and the generated inductance La [nH] obtained by the electromagnetic field simulator commercially available, with the capacitance Cc of the chip=0.7 pF as mentioned above. In order to obtain the inductance La=40 nH for the resonance with the capacitance, it is seen that the lateral length L2 of the inductance portion 6 is approximately 30 mm as mentioned above. The radiation resistance is 1200 Ω at this time.

Although it is possible to use a chip inductance commercially available instead of a loop-like inductance, the chip inductance requires much cost and labor hour. Therefore, the inductance portion is generally formed by using such a loop-like pattern. Also, by using a part of the first dipole portion as an inductance, the whole antenna can be downsized.

Thus, the dimensions of the folded dipole antenna 1 shown in FIG. 1 are determined.

Figure 6:
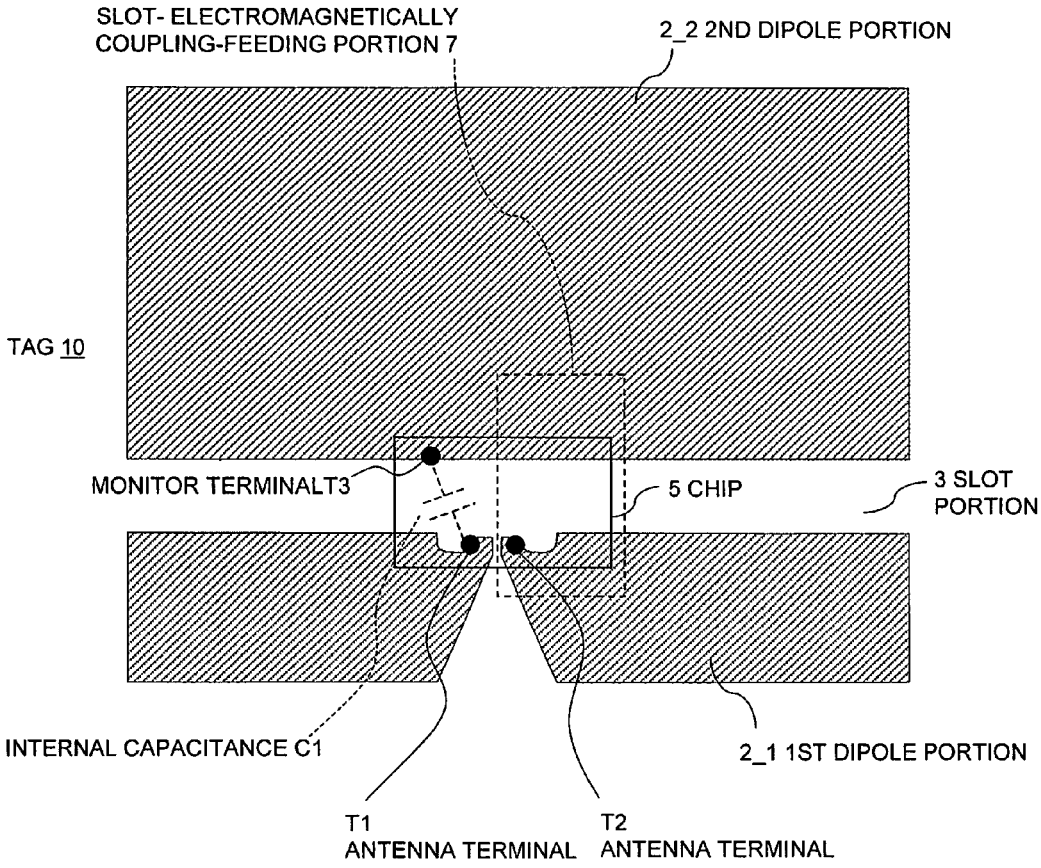
FIG. 6 is a plane view showing in closeup a vicinity of a chip mounting part of an embodiment [2] of a tag according to the present invention.

Embodiment [2] of Tag: FIG. 6

While the chip 5 is directly connected to the antenna terminals T1 and T2 of the first dipole portion 2_1 in the above-mentioned embodiment [1], the chip 5 is also directly connected to the second dipole portion 2_2 as shown in FIG. 6 in the embodiment [2].

Namely, not only the input/output terminals for the connection to the antenna terminals T1 and T2 but also another (second) terminal such as a monitor terminal T3 as the third terminal is provided in the chip 5 in some cases. In such cases, the monitor terminal T3 is directly connected to the second dipole portion 2_2.

Since the antenna terminal T1 and the monitor terminal T3 assume the same potential on a high frequency basis through a capacitance C1 inherently existing within the chip 5, a high-frequency circuit of the antenna terminal T1—capacitance C1—second dipole portion 2_2—antenna terminal T2 is formed, so that the feeding portion 7 is provided through the slot portion 3 between the terminal T2 of the first dipole portion 2_1 and the second dipole portion 2_2 in the same way as the above-mentioned embodiment [1]. Namely, in the case of the embodiment [2], it is made easier to provide the high-frequency circuit (feeding portion) by using the internal capacitance C1 than the case of the embodiment [1].

Thus, also in the embodiment [2], the linearly-polarized wave in the dipole mode DM and the linearly-polarized wave in the slot mode SM as shown in FIG. 3 are generated, thereby enabling a signal transmission/reception to/from the reader/writer to be more effectively performed and the communication distance to be increased.

Figure 7:
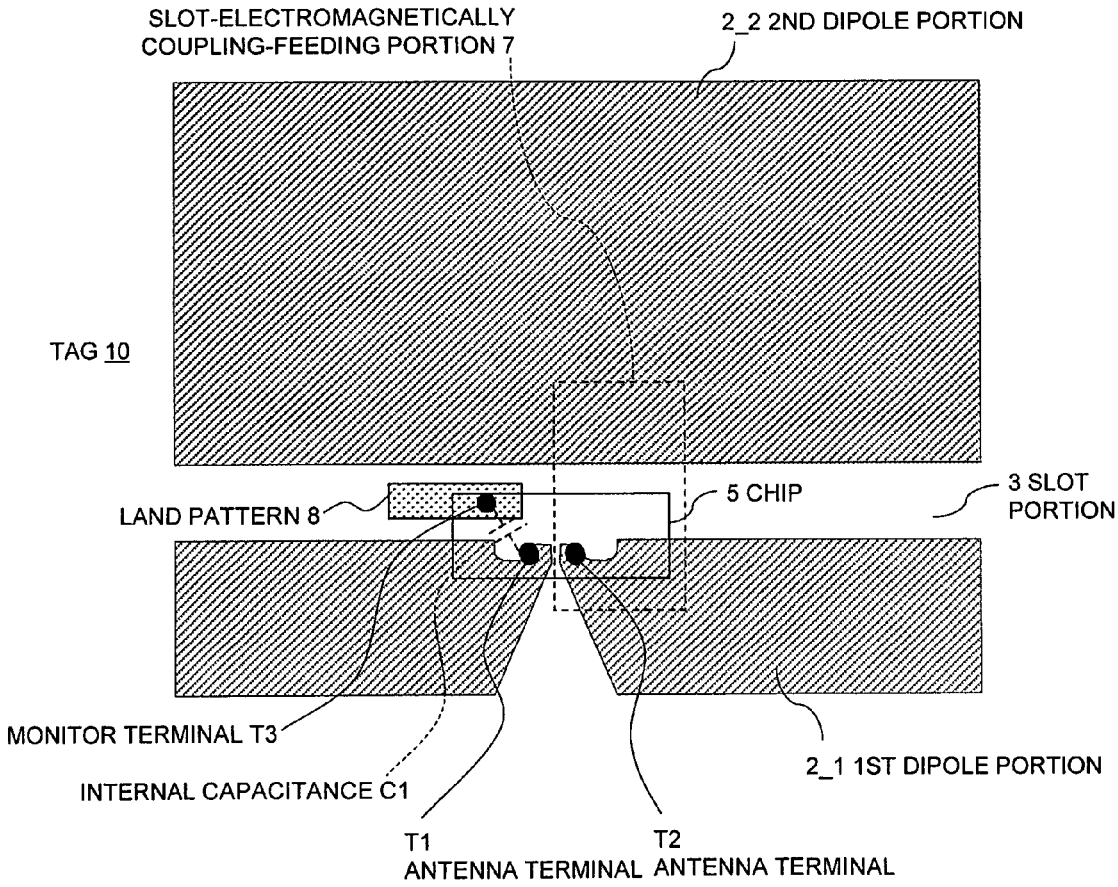
FIG. 7 is a plane view showing in closeup a vicinity of a chip mounting part of an embodiment [3] of a tag according to the present invention.
Figure 8:
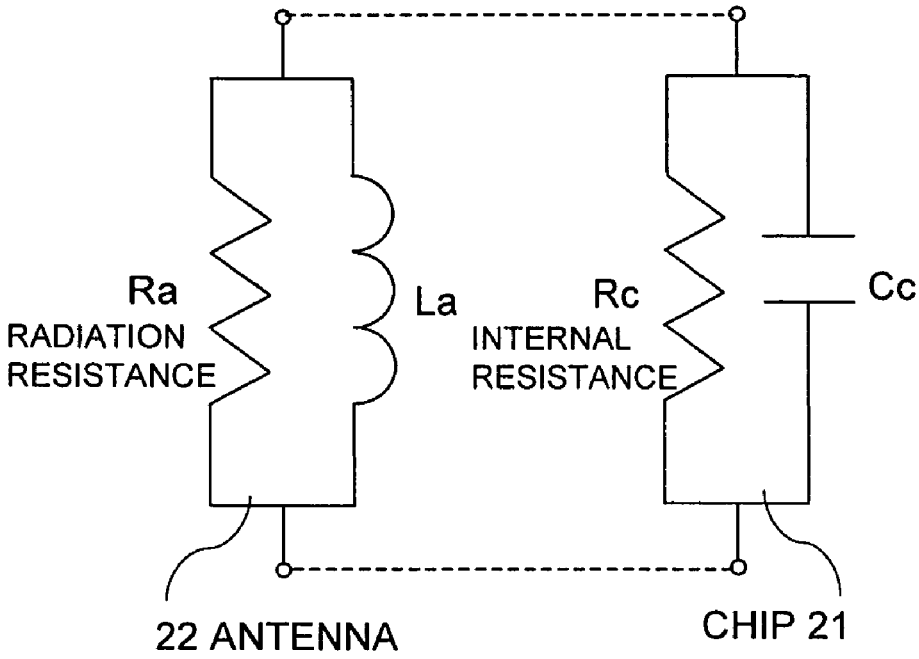
FIG. 8 is a diagram showing a general equivalent circuit of an RFID tag.
Figure 9:
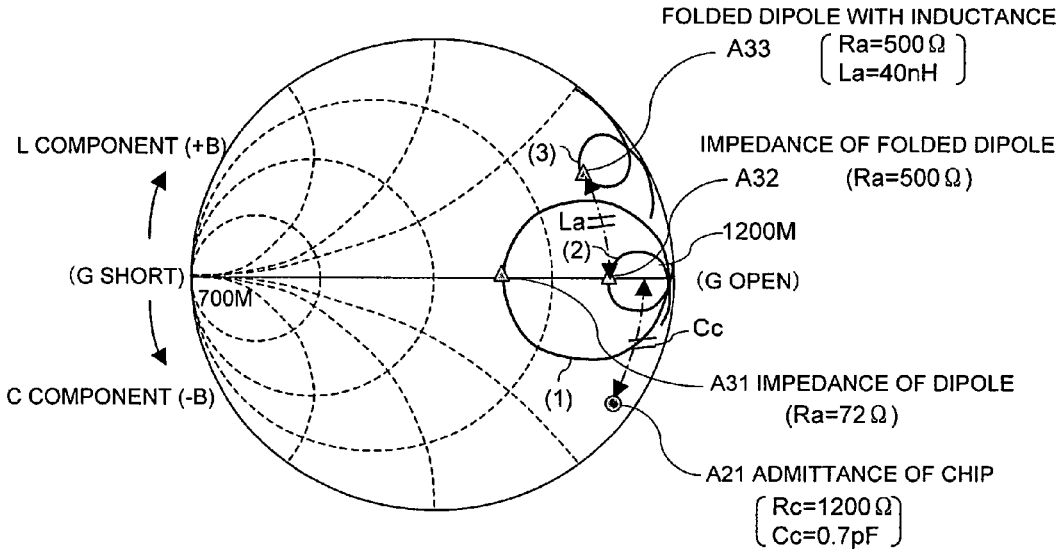
FIG. 9 is an admittance chart (700 MHz-1200 MHz: fo=953 MHz) using various antennas according to an RFID tag.
Figure 10A:
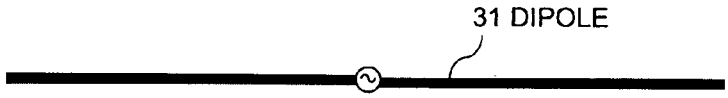
FIGS. 10A-10C are diagrams showing an antenna example for an RFID tag.
Figure 10B:
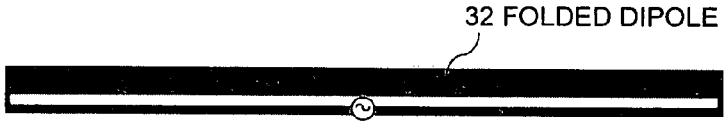
Figure 10C:
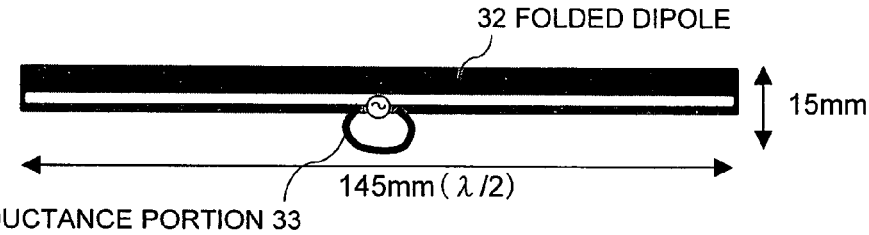
Figure 11:
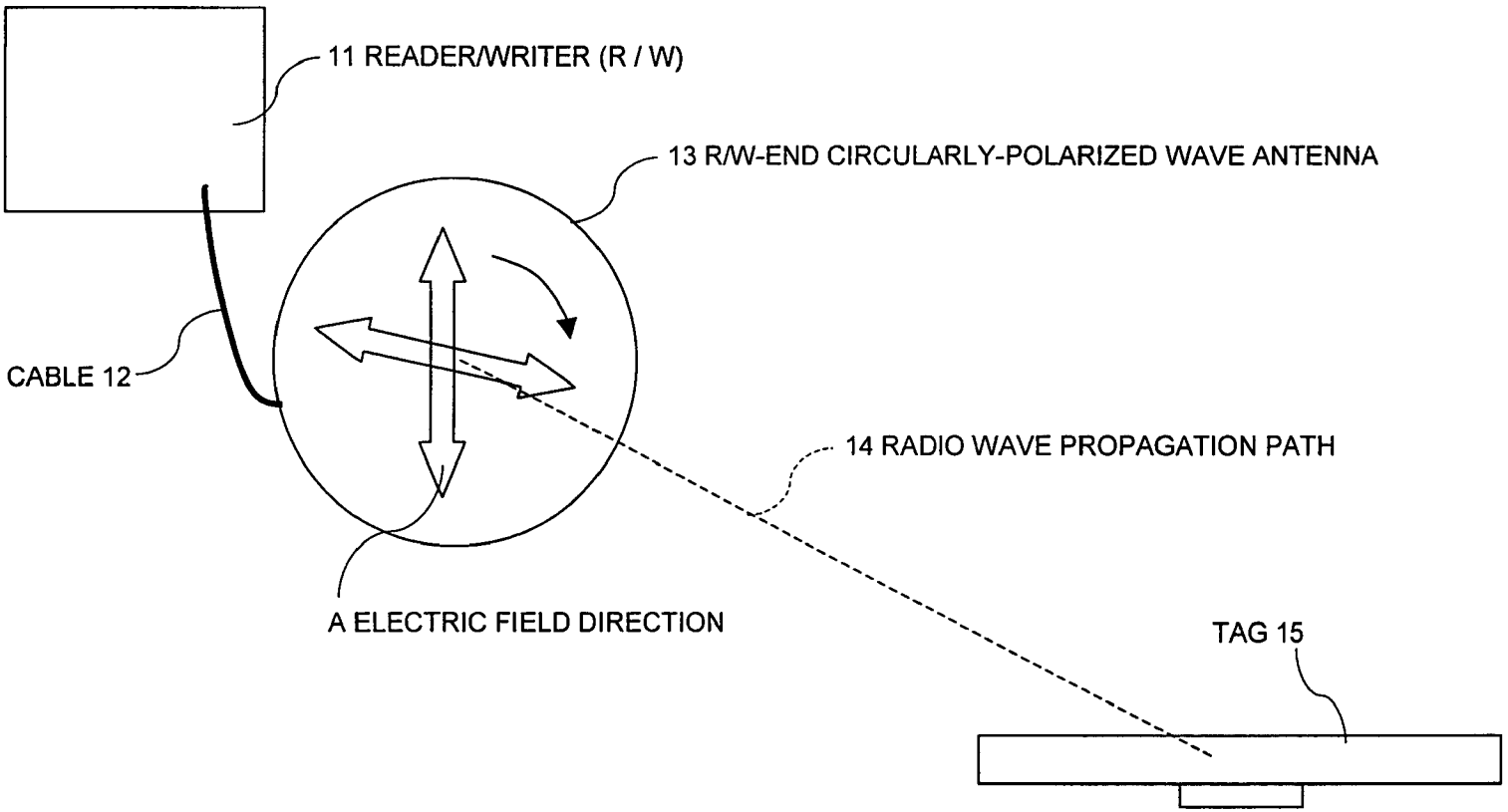
FIG. 11 is a diagram of a generally-known RFID system.
Figure 12:
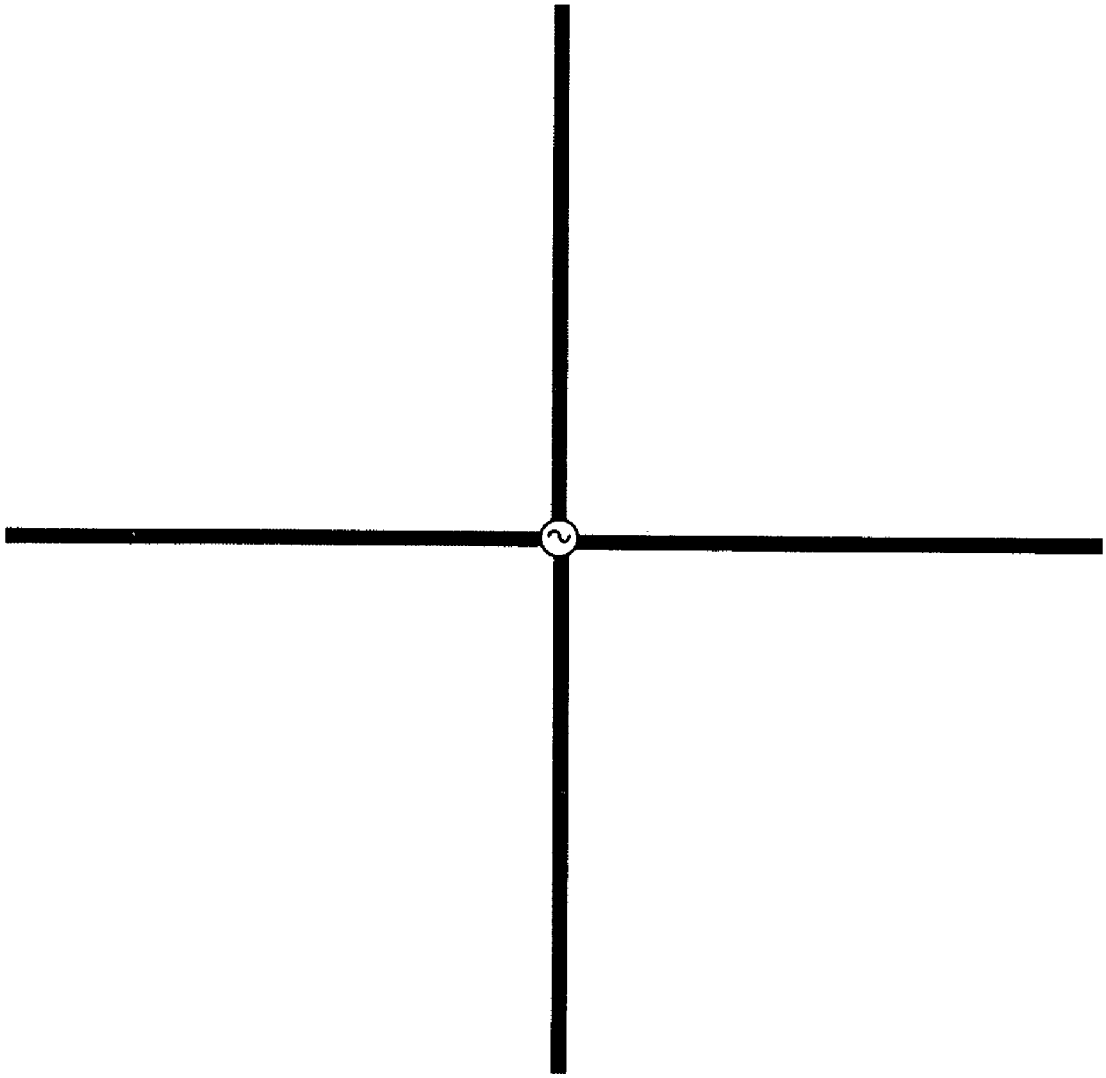
FIG. 12 is a diagram showing a generally-known cross dipole.

Embodiment [3] of Tag: FIG. 7

The embodiment [3] is provided with an arrangement intermediate between the above-mentioned embodiments [1] and [2].

Namely, as shown in FIG. 7, a land pattern 8 is provided in the slot portion 3, and the land pattern 8 and the monitor terminal T3 of the chip 5 are mutually connected. Thus, the monitor terminal T3 of the land pattern 8 and the antenna terminal T1 are made the same potential on a high frequency basis by the internal capacitance C1. Since the capacitance exists on a high frequency basis between the land pattern 8 and the second dipole portion 2_2, a high-frequency circuit consisting of the antenna terminal T1—internal capacitance C1—monitor terminal T3—second dipole portion 2_2—antenna terminal T2 is formed, thereby providing the feeding portion 7 as indicated by a dotted line between the antenna terminal T2 and the second dipole portion 2_2.

Accordingly, also in this embodiment, the linearly-polarized wave in the dipole mode DM and the linearly-polarized wave in the slot mode SM as shown in FIG. 3 are generated in the same way as the above-mentioned embodiments [1] and [2], thereby enabling a signal transmission/reception to/from the reader/writer to be more effectively performed.

It is to be noted that the present invention is not limited to the above-mentioned embodiments and it is obvious that various modifications may be made by one skilled in the art based on the recitation of the claims.

What is claimed is:

1. A folded dipole antenna comprising:

a first dipole portion having a feeding portion; and a second dipole portion having ends connected to ends of the first dipole portion to form a slot portion; wherein a length, in a longitudinal direction of the slot portion, of the first and the second dipole portions being $\lambda/2$ in an RFID frequency bandwidth, and a total sum ($W_1+W_2$) of a width ($W_1$) of the first dipole portion and a width ($W_2$) of the second dipole portion in the perpendicular direction to the longitudinal direction of the slot portion being about $W_1+W_2=\lambda/20$ for generating a linearly-polarized wave in the perpendicular direction to the slot portion, when a RFID chip is mounted on the feeding portion.

2. The folded dipole antenna as claimed in claim 1, wherein an inductance portion for impedance matching with the chip is connected to the first dipole portion, in parallel with the feeding portion.

3. The folded dipole antenna as claimed in claim 1, wherein the first and the second dipole portion comprise conductors consisting of Cu, Ag, or Al, and are fixed on a sheet consisting of PET, film, or paper.

4. A tag in the folded dipole antenna as claimed in claim 1, wherein input/output terminals of the chip are connected to antenna terminals of the feeding portion.

5. The tag as claimed in claim 4, wherein another terminal of the chip is connected to the second dipole portion.

6. The tag as claimed in claim 4, wherein a land pattern is provided in the slot portion and another terminal of the chip is connected to the land pattern.

7. The tag as claimed in claim 4, wherein the first and the second dipole portion comprise conductors consisting of Cu, Ag, or Al, and are fixed on a sheet consisting of PET, film, or paper.

* * * * *